United States Patent [19]

Koudijs

[11] Patent Number: 4,721,918

[45] Date of Patent: Jan. 26, 1988

[54] PROCESS AND APPARATUS FOR THE EXCHANGE OF EMISSION SOURCES

[75] Inventor: Renée Koudijs, Amersfoort, Netherlands

[73] Assignee: High Voltage Engineering Europa B.V., Amersfoort, Netherlands

[21] Appl. No.: 752,120

[22] Filed: Jul. 5, 1985

[30] Foreign Application Priority Data

Jul. 19, 1984 [NL] Netherlands ..... 8402284

[51] Int. Cl.[4] ..... H05H 15/00; H01J 1/92; G21F 5/02

[52] U.S. Cl. ..... 328/233; 250/497.1; 313/237

[58] Field of Search ..... 328/233, 256; 250/288, 250/497.1; 313/237

[56] References Cited

U.S. PATENT DOCUMENTS

| | | | |
|---|---|---|---|
| 2,531,065 | 11/1950 | Livingood et al. | 313/237 X |
| 3,476,972 | 11/1969 | Katagiri et al. . | |
| 3,601,649 | 8/1971 | Steigerwald . | |
| 3,723,791 | 3/1973 | Stocklein | 313/237 |
| 3,757,404 | 9/1973 | Bill . | |

FOREIGN PATENT DOCUMENTS

| | | | |
|---|---|---|---|
| 58-35851 | 3/1983 | Japan | 313/237 |

OTHER PUBLICATIONS

Search Report NL 84 02 284 No. 127632.
Translation of summary in French Specification No. 1.536.468.

*Primary Examiner*—David K. Moore
*Assistant Examiner*—Sandra L. O'Shea
*Attorney, Agent, or Firm*—Majestic, Gallagher, Parsons & Siebert

[57] ABSTRACT

Apparatus for the exchange of emission sources of a particle accelerator located in an accelerator vessel filled with a gaseous insulating medium, comprising a gastight source-exchange chamber (3) which is connected by means of a line (26) that can be closed by an exchange valve (8) to the accelerator vessel (17), the said chamber (3) being provided on the inside with a movable exchange member (4 and 5, respectively) having at least one hole (41 and 51, respectively) and at least two holders (43, 44 and 53, 54, respectively) for the emission sources (6a, 6b) to be exchanged, one or more lead-through rods (1) for the transfer of an emission source from the accelerator vessel (17) to the exchange chamber (3) or from the exchange chamber (3) to the accelerator vessel (17), as well as means for placing the movable exchange member (4 and 5, respectively) in the desired position relative to the exchange valve (8).

17 Claims, 3 Drawing Figures

PROCESS AND APPARATUS FOR THE EXCHANGE OF EMISSION SOURCES

The invention relates to a process and apparatus for the exchange of emission sources of accelerators for charged particles such as high-energy electrons and ions.

In particle accelerators of this type the accelerator tube in which the electrons or ions originating from the emission source are accelerated in vacuo to the desired exit velocity is located in an accelerator vessel. The emission source is generally encased in a metal jacket in order to ensure that the electrical field strength within the accelerator vessel increases or decreases gradually. Such an emission source is accommodated in a recess in the said jacket. In direct line with the accelerator tube lies the exit tube which extends through the wall of the accelerator vessel, so that the emerging electron or ion beam can be applied for the end in view.

The emission source may be positioned either direct against one end of the accelerator or against one end of a chamber provided with means for modifying the emission, for instance focussing of the emitted electron or ion beam, or selecting certain desired types of ion.

In order to prevent spark-gap breakdown or leak currents between the accelerator tube, the metal jacket and the wall, the accelerator vessel is filled with a gaseous insulating medium. The medium may consist of, for instance, dry air or nitrogen, but at higher voltages it is not uncommon to use certain fluorine compounds such as sulfur hexafluoride.

If it is desirable to remove and exchange the emission source in the accelerator vessel, the equipment must be put out of operation and the vessel opened in order to gain access to the emission source. This is a time-consuming and therefore expensive operation, especially when the accelerator vessel is filled with a costly insulating medium such as sulfur hexafluoride. In that case it is necessary to pump the insulating medium out of the vessel and store it temporarily in another vessel. After the emission source has been exchanged, the insulating medium can be refed into the vessel.

To obviate these drawbacks, it is therefore desirable to have available a process and equipment whereby the exchange of the emission source can be effected without having to open the accelerator vessel.

The present invention provides such a process as well as apparatus for operating this process. According to the invention, the process for the exchange of emission sources of a particle accelerator which are positioned in an accelerator vessel filled with a gaseous insulating medium consists in that the emission source located in the accelerator vessel which is due for exchange is displaced to a gastight space provided outside the accelerator vessel and filled with the same gaseous insulating medium at the same pressure as the pressure in the accelerator vessel and that another emission source is moved from this gastight space to the desired position in the accelerator vessel.

The apparatus for operation of this process comprises a gastight source-exchange chamber which is connected to the accelerator vessel by means of a line that can be closed by an exchange valve, and which chamber is provided on the inside with a movable member having at least one exchange hole and at least two holders for the emission sources to be exchanged, one or more lead-through rods for the lateral transfer of an emission source from the accelerator vessel to the exchange chamber, or from the exchange chamber to the accelerator vessel, as well as means for bringing the movable member into the desired position relative to the exchange valve.

The apparatus according to the invention is preferably provided with means for evacuation of the exchange chamber, means for equilibration of the gas pressures in the exchange chamber and the accelerator vessel, as well as means for pumping the gaseous insulating medium from the exchange chamber back into the accelerator vessel. These provisions are of particular importance when use is made of costly gaseous insulating media such as sulfur hexafluoride, and they will be discussed more fully in the description of the figures.

The movable exchange member provided in the exchange chamber is preferably a rotating disk which can turn on a shaft aligned in parallel with the axis of the accelerator tube and which is provided with at least one hole for the transfer of the emission sources and with means for detachably holding the said sources, whilst the disk can be turned by means of a knob to the desired position relative to the line which may be closed by an exchange valve. Alternatively, however, the exchange member may be designed as a laterally displaceable slide provided with at least one hole for the transfer of the emission sources and with means for detachably holding the said sources. These means for detachably holding the emission sources on the exchange member preferably consist of bayonet locks. Alternatively, however, use may be made of other means of attachment such as electromagnetic clamps.

The invention will now be elucidated by reference to the attached drawings.

Figure 1:
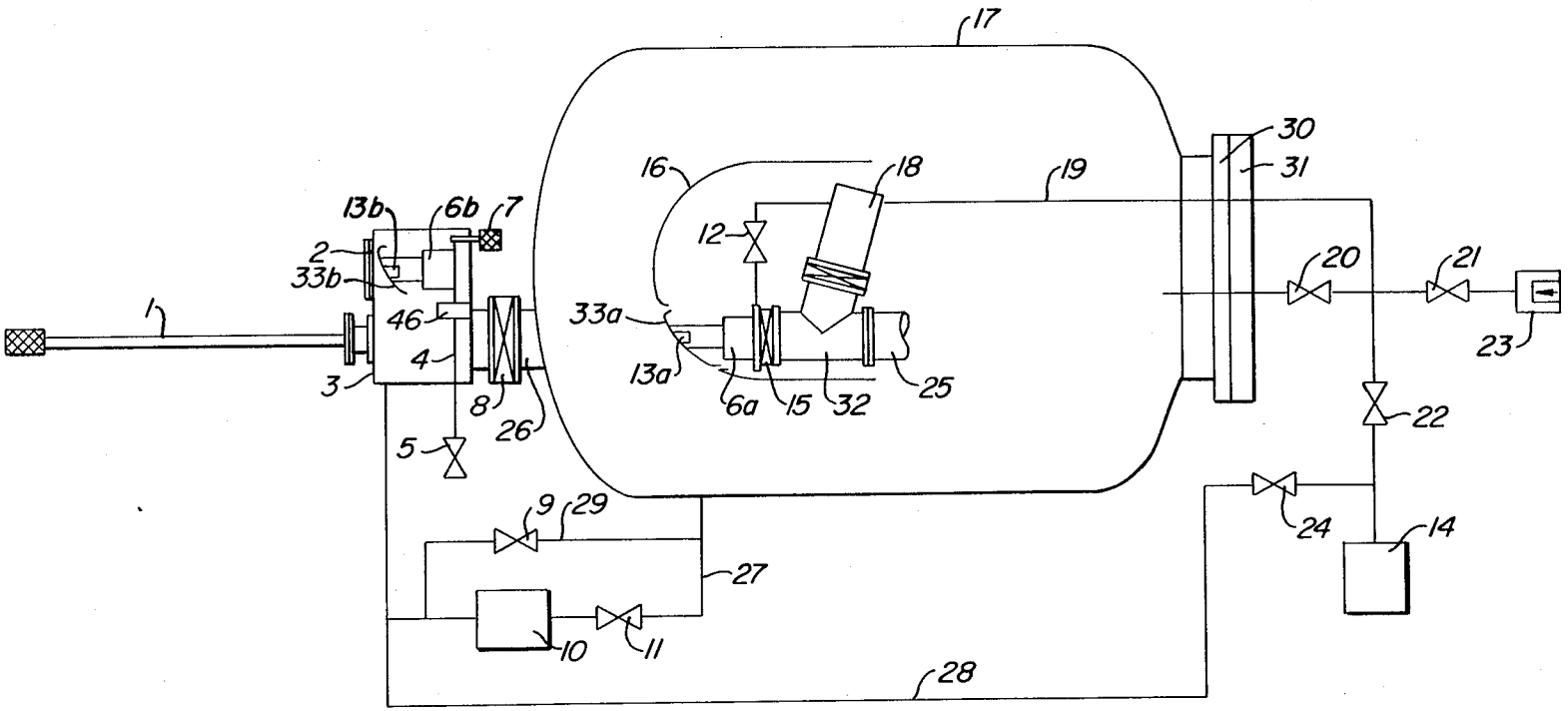
FIG. 1 is an elevation view of the particle accelerator.

FIG. 1 depicts a particle accelerator consisting of an emission source 6a which links up with a chamber 32 through a valve 15, provided with means for the modification of the radiation originating from the emission source 6*a*, as well as an accelerator tube 25 by which the electrons or ions emitted are accelerated to the desired final velocity. The emission source 6*a* can be evacuated through the line 19 provided with a stopcock 12 by means of a gas pump 14 which is positioned outside the accelerator vessel 17. The whole is accommodated within an accelerator vessel 17, which is accesible through a manhole 30. During operation of the equipment, the manhole 30 is sealed by the lid 31. The accelerator tube 25 and the chamber 32 are maintained at a high vacuum with the aid of the vacuum pump 18, which may be disposed either inside or outside the accelerator vessel 17.

The assembly comprising emission source 6*a*, valve 15, chamber 32 and line 19 with its stopcock 12 is encased in a metal jacket 16. The accelerator tube 25 may be surrounded by a number of rings made of an electrically conductive material and fitted against the jacket 16 towards the manhole 30. Both these rings and the jacket 16 serve the purpose of ensuring that the field strength within the accelerator vessel 17 increases and decreases gradually.

The emission source 6*a* is provided with a connection 13*a*, capable of engaging the lead-through rod 1 to be discussed hereinafter, and with a lid 33*a* fitting into a recess in the jacket 16 with which it makes a highly conductive electric contact when the source 6*a* occupies its position resting against valve 15.

In direct line with the accelerator tube 25 lies the exit tube which extends through the lid 31 to project outside the accelerator vessel 17 and through which the electron or ion beam accelerated to the desired final velocity leaves the equipment.

For the sake of clearness and ready reference, the electrically conductive rings surrounding the accelerator tube 25 and the exit tube are not depicted in this schematic representation.

On the side of the accelerator vessel 17 facing away from the manhole 30 there is a source-exchange chamber 3 which is accessible through the inlet port 2 and which is connected through the line 26 to the accelerator vessel 17. The source-exchange chamber 3 accommodates the exchange member 4, in this case designed as a rotating disk which can turn on a shaft 46 aligned in parallel with the axis of the accelerator tube. The rotating disk 4 can be turned by means of a knob 7 in order to place it in the desired position relative to the exchange line 26. To ensure a gastight sealing of the accelerator vessel during operation of the particle accelerator, line 26 is provided with an exchange valve 8.

Also in direct line with the axis of the accelerator tube 25 a lead-through rod 1 is provided, which can be moved laterally and with which the emission source 6*a* to be exchanged can be withdrawn from the accelerator vessel. After the removal of the emission source 6*a*, the said lead-through rod 1 can also be used to insert the new emission source 6*b* placed on the rotating disk 4 into the accelerator vessel. For correct positioning of the emission source during insertion into the accelerator vessel, the lead-through rod 1 may, in additon, be rotated on its axis. The emission source 6*b* is likewise provided with a connection 13*b* for engagement of the lead-through rod 1 and with a lid 33*b* corresponding in form to the aforesaid lid 33*a*.

Figure 2:
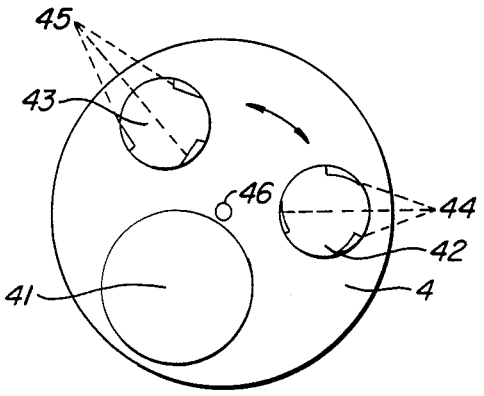
FIG. 2 is a diagrammatic representation of the exchange member.

FIG. 2 is a diagrammatic representation of the exchange member 4 as described hereinbefore. It comprises a shaft 46, an exchange hole 41, two holders for the emission sources 42 and 43, as well as means of attachment 44 and 45, in this instance designed as bayonet locks.

Figure 3:
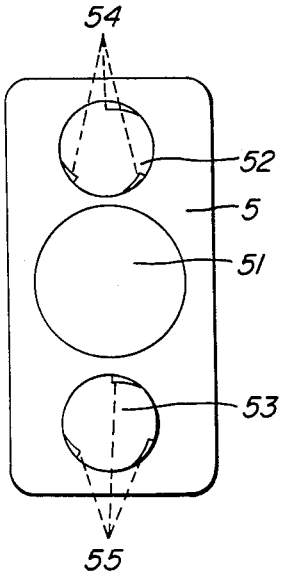
FIG. 3 is another embodiment of the exchange member.

FIG. 3 shows another embodiment of the exchange member, taking the form of a slide construction 5, provided with exchange hole 51 and two holders for the emission sources 52 and 53 with means of attachment 54 and 55.

The significance of the other reference numerals in FIG. 1 will be explained more fully in the following description of the mode of operation of the apparatus according to the invention.

Before proceeding to exchange the emission sources 6*a* and 6*b*, one should first of all cut out the high-voltage supply, which usually ranges from 200 kV to 5 MV.

If dry air at atmospheric pressure is used as insulating medium in the accelerator vessel 17 (that is, at relatively low voltages), the exchange of the emission sources 6*a* and 6*b* is conducted the following way. With the aid of knob 7, the rotating disk 4 is turned to such a position that the exchange hole 41 is directly in front of line 26. Then the exchange valve 8 is opened and the lead-through rod 1 moved to the right to the point where it engages the connection 13*a* fitted to the emission source 6*a*. Next, by opening stopcocks 12 and 20 air is admitted to the vacuum zone of the emission source 6*a* and the space between valve 15 and emission source 6*a*, so that the latter becomes detached from its seals. If required, it is possible after closure of stopcock 20 to open valve 21 and to put the space between valve 15 and emission source 6*a* with the aid of pump 23 under a slight positive pressure vis-à-vis the pressure in the accelerator vessel 17. Subsequently, the lead-through rod 1 is moved to the left, so that the emission source 6*a* with the lid 33*a* is withdrawn through the exchange valve 8 and line 26, and also through the exchange hole 41, into the exchange chamber 3. The rotating disk 4 is then turned by means of knob 7 to a position where the holder 42 faces the emission source 6*a* in the exchange chamber 3. By a slight angular displacement of the lead-through rod 1, the emission source 6*a* is then fixed in position on the bayonet lock 44 of the holder 42. Thereupon, the rotating disk 4 is turned again with the aid of knob 7 to such a position that the holder 43 with the emission source 6*b* and the lid 33*b* faces line 26. Then the lead-through rod 1 is moved to the right again until it is engaged by the connection 13*b* of the emission source 6*b*. A slight angular displacement of the lead-through rod 1 releases the emission source 6*b* from the bayonet lock 45 of the holder 43. Next, the rotating disk 4 is turned by means of knob 7 to a position where the hole 41 faces line 26, whereupon the lead-through rod 1 pushes the emission source 6*b* through the appropriate hole in the jacket 16 into the accelerator vessel 17 as far as the valve 15, so that the lid 33*b* seals the recess in the jacket 16. After closure of the two stopcocks 20 and 21 and opening of stopcocks 12 and 22, the emission source 6*b* and the space between this source and valve 15 are evacuated through line 19 by means of the vacuum pump 14, causing the source to adhere tightly to valve 15. Then the lead-through rod 1 is withdrawn from the accelerator vessel 17, whereupon the exchange valve 8 is closed. After closure of the stopcocks 12 and 22 the particle accelerator is ready to be returned to service. The emission source 13*a* can subsequently be removed from the exchange chamber 3 through the inlet port 2.

If pressurized air or nitrogen is used as gaseous insulating medium in the accelerator vessel 17, it is necessary to equalize the pressure in the source-exchange chamber 3 and in the accelerator vessel 17, before proceeding to exchange the sources. To this end, the two vessels may be interconnected by means of line 29 which can be closed by a valve 9. If required, the source-exchange chamber 3 may previously be evacuated by means of the vacuum pump 14 through the line 28 which can be closed by a stopcock 24.

If expensive gases, such as sulfur hexafluoride, are used as gaseous insulating medium in the accelerator vessel 17, it is desirable with a view to obviating losses to pump the gas present in the source-exchange chamber 3 back into the accelerator vessel 17 after completion of the exchange procedure. This may be done by means of the gas pump 10 through the line 27 which can be closed by a valve 11.

The apparatus according to the invention can be operated wholly by hand. Alternatively, however, the apparatus may be provided with means for automatically conducting the various operations involved in the exchange of emission sources.

Obviously, still other operating sequences are possible within the purview of the invention, depending on the nature of the gaseous insulating medium and the emission source.

The apparatus according to the invention can also be used for particle accelerators where more than one accelerator tube is incorporated in the accelerator vessel. In that case, the exchange member 4 (or 5, as the case may be) must be provided with more than two holders for recieving and delivering emission sources.

The process and the apparatus according to the invention make it possible to exchange the emission source of a particle accelerator located in an accelerator vessel within a space of time from 10 minutes to one hour, whereas the process customarily used until now required a time ranging from 4 to 24 hours.

I claim:

1. A process for the exchange of an emission source of a particle accelerator located in an accelerator vessel filled with a gaseous insulating medium with a replacement emission source comprising the steps of:

connecting an external gastight container to the accelerator vessel, said container capable of having a gaseous state independent from that of the accelerator vesel, and defining therein an exchange chamber for housing at least one replacement emission source;

filling said container with the same gaseous insulating medium at the same pressure as that in the accelerator vessel;

transferring the emission source to be exchanged in the accelerator vessel to the gastight container; and moving one of the replacement emission source from the gastight container to a desired position in the accelerator vessel.

2. An apparatus for exchanging an emission source in an accelerator vessel with a replacement emission source, said apparatus comprising:

an external gastight source-exchange container connected to the accelerator vessel, said container capable of having a gaseous state independent from that of the accelerator vessel, and defining therein an exchange chamber for housing at least one replacement emission source; and means for transferring the emission source in the vessel to the container and for moving the replacement emission source from said container to the vessel.

3. The apparatus of claim 2, said transferring and moving means comprising:

a lne by which said exchange chamber is connected to the accelerator vessel;

an exchange valve which controls the passage through said line;

a movable exchange member in said exchange chamber having at least one hole and at least two holders for the emission sources to be exchanged;

means for placing said movable exchange member in the desired position relative to said exchange valve;

one or more lead-through rods for the transfer of the emission source from the accelerator vessel to said exchange chamber or from said exchange chamber to the accelerator vessel.

4. Apparatus according to claim 3, which further comprises means for evacuating said exchange chamber.

5. Apparatus according to claim 3, which further comprises means for equalizing the gas pressure in said exchange chamber and that in the accelerator vessel.

6. Apparatus according to claim 3, which further comprises:

means for evacuating said exchange chamber;

means for equalizing the gas pressure in said exchange chamber and that in the accelerator vessel; and means for pumping the gaseous insulating medium from said exchange chamber back into the accelerator vessel.

7. Apparatus according to claim 3, characterized in that said movable exchange member comprises:

a rotating disk which can turn on a shaft disposed parallel to the axis of the accelerator tube of the accelerator vessel, said rotating disk being provided with at least one hole for the passage of the emission sources during their transfer; and means for detachably holding said sources, and a knob by which means the rotating disk can be turned to the desired position relative to said line.

8. Apparatus according to claim 7, characterized in that the means for detachably holding the emission sources consist of bayonet locks.

9. Apparatus according to claim 3, characterized in that said movable exchange member comprises:

a laterally displaceable slide, provided with at least one hole for the passage of the emission sources during their transfer; and means for detachably holding said sources.

10. Apparatus according to claim 9, characterized in that the means for detachably holding the emission sources consist of bayonet locks.

11. Apparatus according to claim 3, wherein the sequence of operations required for the exchange of an emission source is conducted by automatic means.

12. Apparatus according to claim 6, characterized in that said movable exchange member comprises:

a rotating disk which can turn on a shaft disposed parallel to the axis of the accelerator tube of the accelerator vessel, said rotating disk being provided with at least one hole for the passage of the emission sources during their transfer; and means for detachably holding said sources; and a knob by which means the rotating disk can be turned to the desired position relative to said line.

13. Apparatus according to claim 12, characterized in that the means for detachably holding the emission sources consist of bayonet locks.

14. Apparatus according to claim 6, characterized in that said movable member comprises:

a laterally displaceable slide, provided with at least one hole for the passage of the emission sources during their transfer; and means for detachably holding said sources.

15. Apparatus according to claim 14, characterized in that the means for detachably holding the emission sources consist of bayonet locks.

16. Apparatus according to claim 6, wherein the sequence of operations required for the exchange of an emission source is conducted by automatic means.

17. Apparatus according to claim 2, wherein the sequence of operations required for the exchange of an emission source is conducted by automatic means.

* * * * *